US005758730A

United States Patent [19]

Derwand

[11] Patent Number: 5,758,730

[45] Date of Patent: Jun. 2, 1998

[54] METHOD FOR REMOVING AN EARTH CORE OUT OF A PIPE LAID IN TRENCHLESS MANNER AND GO-DEVIL FOR IMPLEMENTING THE METHOD

[76] Inventor: Horst Derwand, Berliner Strasse 9, D-35236 Breidenbach, Germany

[21] Appl. No.: 687,442

[22] PCT Filed: Feb. 9, 1995

[86] PCT No.: PCT/DE95/00159

§ 371 Date: Aug. 14, 1996

§ 102(e) Date: Aug. 14, 1996

[87] PCT Pub. No.: WO95/21984

PCT Pub. Date: Aug. 17, 1995

[30] Foreign Application Priority Data

Feb. 15, 1994 [DE] Germany ..... 44 04 712.6

[51] Int. Cl.[6] ..... E21B 3/02; E02D 29/10

[52] U.S. Cl. ..... 175/20; 175/99; 405/184

[58] Field of Search ..... 175/20, 99; 405/184

[56] References Cited

U.S. PATENT DOCUMENTS

| | | | |
|---|---|---|---|
| 4,314,615 | 2/1982 | Sodder, Jr. et al. . | |
| 4,369,002 | 1/1983 | Kostylev et al. | 405/184 |
| 4,456,078 | 6/1984 | Adam . | |
| 4,732,226 | 3/1988 | Ebeling et al. | 175/99 X |
| 5,240,352 | 8/1993 | Ilomäki | 405/184 |
| 5,613,568 | 3/1997 | Sterner et al. | 175/99 X |

FOREIGN PATENT DOCUMENTS

| | | |
|---|---|---|
| 3431233-A1 | 3/1986 | Germany . |
| 4219676-A1 | 12/1993 | Germany . |

*Primary Examiner*—William P. Neuder

*Attorney, Agent, or Firm*—Nikaido, Marmelstein, Murray & Oram LLP

[57] ABSTRACT

A go-devil (1) is inserted into a pipe end of a pipe (5) laid in place in trenchless manner by ramming or pressing and of which the earth core (7) shall be removed by a method of the invention, said go-devil being displaced longitudinally through said pipe and forcing the said earth core out at the other pipe end. The advance of the go-devil (1) takes place step by step by means of a length-variable actuator (10) bracing itself against the inside wall (4) of the pipe (5), said actuator after each forward stroke being returned into its initial position and its bracing being made to follow in the direction of advance by the amount of the step taken. The go-devil (1) is composed of a head plate (2), a length-variable actuator (10) and bracing systems (11, 22), the head plate (2) being linked to one end of the actuator (10) and to a first bracing system (11) and the other end of the actuator (10) being linked to a second bracing system (22), these bracing systems (11, 22) being alternatively displaceable into one bracing position wherein they can be forced against the inside wall (4) of a pipe or into a disengaged position wherein they are off the inside wall (4) of the pipe.

10 Claims, 5 Drawing Sheets

Figure 1:
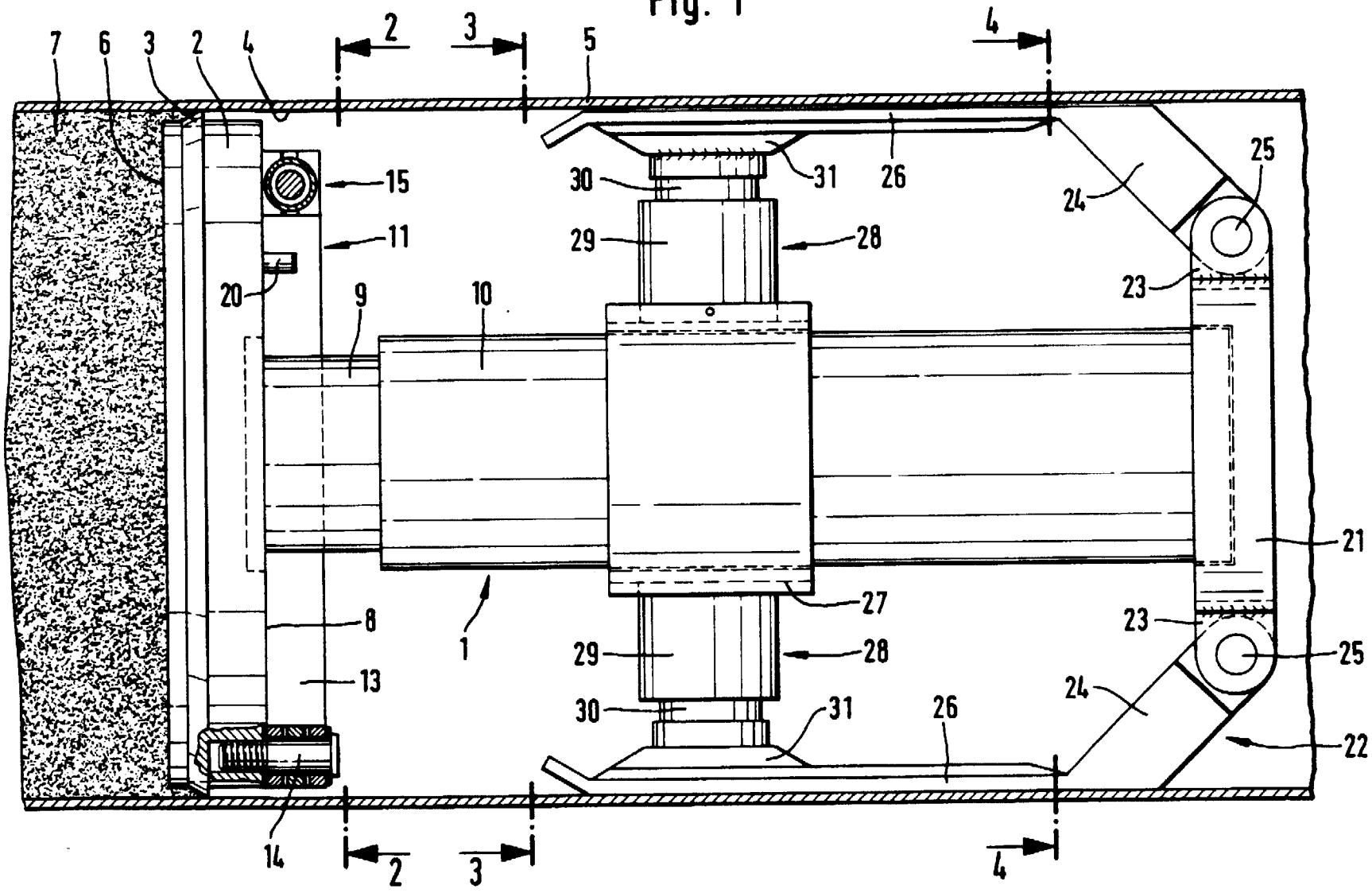

METHOD FOR REMOVING AN EARTH CORE OUT OF A PIPE LAID IN TRENCH-LESS MANNER AND GO-DEVIL FOR IMPLEMENTING THE METHOD

The invention concerns a method for removing a core of earth, herein called earth core, out of a pipe laid in trench-less manner by ramming or pressing, the two pipe ends of the pipe being free, a go-devil being inserted in the method in one pipe end and being moved through the pipe, whereby the go-devil forces the earth core out of the other pipe end.

When laying piping in trench-less manner, foremost the pipe advance by means of pipe ramming and pipe pressing has been found practical. The method offers substantial advantages in rolling terrain, also in terrain with intercalated boulders and in groundwater zones with intercalated layers of quicksand, compared with conventional worm auger procedures. However the method entails special steps to remove the earth core which during pipe advance will enter this pipe through the open head end.

In one known procedure the earth core is driven out of the laid pipe by using a go-devil. In this procedure, the go-devil is foremost pressed with air pumped through an inlet stub sealing the pipe end at a pressure up to 25 bars against the earth core which thereby is pushed out of the other end of the pipe into a catch pit. In this procedure, the earth core exits most of the time at uncontrolled speed and when the go-devil is exiting, there may be expansion in the form of a shock wave of the air remaining inside the pipe and still at high pressure, entailing a substantial danger of accident, and precluded because of the noise in inhabited areas. It is known furthermore to use water instead of air as the pressurized medium. While the use of water allows controlling the exit of the earth core, its use on the other hand entails the drawback that at least inside the catch pit this water will mix with the earth and, depending on the particular terrain, there may ensue a waste-removal problem. Similar facts are the case in another variation of the procedures, wherein the earth core is rinsed with highly pressurized water.

It is also known to ultimately remove the earth core out of the pipe using worm augers. However this latter procedure is very expensive and hence uneconomical.

The object of the invention is to create a method of the initially cited kind allowing in simple, economical manner and with a minimum of danger to the construction or operating personnel to remove the earth core from a pipe laid in trench-less pipe advance.

To solve this problem, the method of the invention provides that the go-devil shall advance stepwise by means of a length-variable actuator which is braced against the pipe inside wall, this actuator after each stroke being returned into its initial position and its bracing being reset in the direction of advance by the amount of the just completed step.

In the method of the invention, the earth core is forced out of the pipe by means of a controlled advance of the go-devil, the go-devil actuator being mechanically braced against the inside wall pipe. Pressurization of the go-devil by filling the piping with water or air is eliminated, and accordingly the drawbacks related to water or air are also precluded. The actuator for the go-devil may be driven hydraulically or electrically and may be connected through hoses or cables as well as through appropriate control systems to an energy source located outside the piping. Because of the supply of drive energy, the motion, of the actuator can be easily controlled.

A further embodiment of the invention concerns a go-devil with which to implement the method of the invention and which is composed of a head plate, a length-variable actuator and bracing systems, the head plate being connected to one end of the actuator and to a first bracing system and the other end of the actuator being connected to a second bracing system, the bracing systems alternatively assuming a bracing position wherein they can be forced against the inside wall of a pipe or are displaceable into a position off the pipe inside wall, and furthermore the actuator and the bracing system are driven by remote-controlled, hydraulic or electric drive means.

The go-devil of the invention is characterized by simple and rugged design and allows easy operation through the control of its drive means. The go-devil is easily adapted to various pipe dimensions in that the head plate and the bracing system are matched to the particular pipe diameter. Such adaptation is implementable in the absence of laborious conversion work. In preferred manner, the actuator and bracing systems shall be operated by hydraulic drive means which may be connected with drive units conventionally used in construction and operated with biologically degradable hydraulic oils. In the invention, the actuator may assume the form a double-acting, hydraulically loaded cylinder affixed by one end constituted of the piston rod or the cylinder housing to the head plate and being affixed by the other end to the second bracing system. Using commensurate control, the cylinder may be extended or retracted and in this manner allows simple resetting of the bracing system. The bracing systems may comprise radially displaceable bracing jaws or bracing shoes supported in the head plate or actuator and which each may be radially compressed outward by an associated hydraulically driven cylinder against the pipe inside wall.

In a further design of the invention, the first bracing system comprises two radially displaceable bracing jaws in the manner of an inside shoe brake, the jaws being rotatably supported by one end on a pin mounted on the head plate while their opposite ends can be moved apart by a spreading device. This design of the first bracing systerrL allows its easy assembly to the rear side of the head plate, the central area of this head plate remaining clear for the affixation of the actuator. A double-acting hydraulic cylinder mounted between the ends of the bracing jaws and linked to them by kinematic articulations is an appropriate spreading device of the invention. Such a design allows moving the bracing jaws in both directions without the need for additional means.

An advantageous design of the invention of the second bracing system provides at least two bracing shoes with skids running in the longitudinal go-devil direction, at least one bracing shoe being radially displaceable by a bracing cylinder resting against the other bracing shoe. The bracing forces generated by the bracing cylinder and required to withstand the reaction created by the actuator's force of advance can be effectively transmitted by the bracing shoes to the pipe wall. At the same time the bracing shoes guide the actuator along the pipe inside wall while the actuator is being reset. An advantageous design provides that the bracing shoes be pivotably supported at a compression plate which is affixed to an end face of the actuator. The compression plate allows transmitting in simple manner high bracing forces from the centrally located actuator to the external bracing shoes. In order to keep the radial bracing forces away from the actuator, this actuator may be enclosed by a ring of the invention which radially braces the bracing cylinder. The ring absorbs the radially inward reactions from the bracing forces and brings them into equilibrium, whereby the actuator inside the ring remains unaffected by the forces.

The invention is elucidated below by an illustrative embodiment shown in the drawing.

Figure 2:
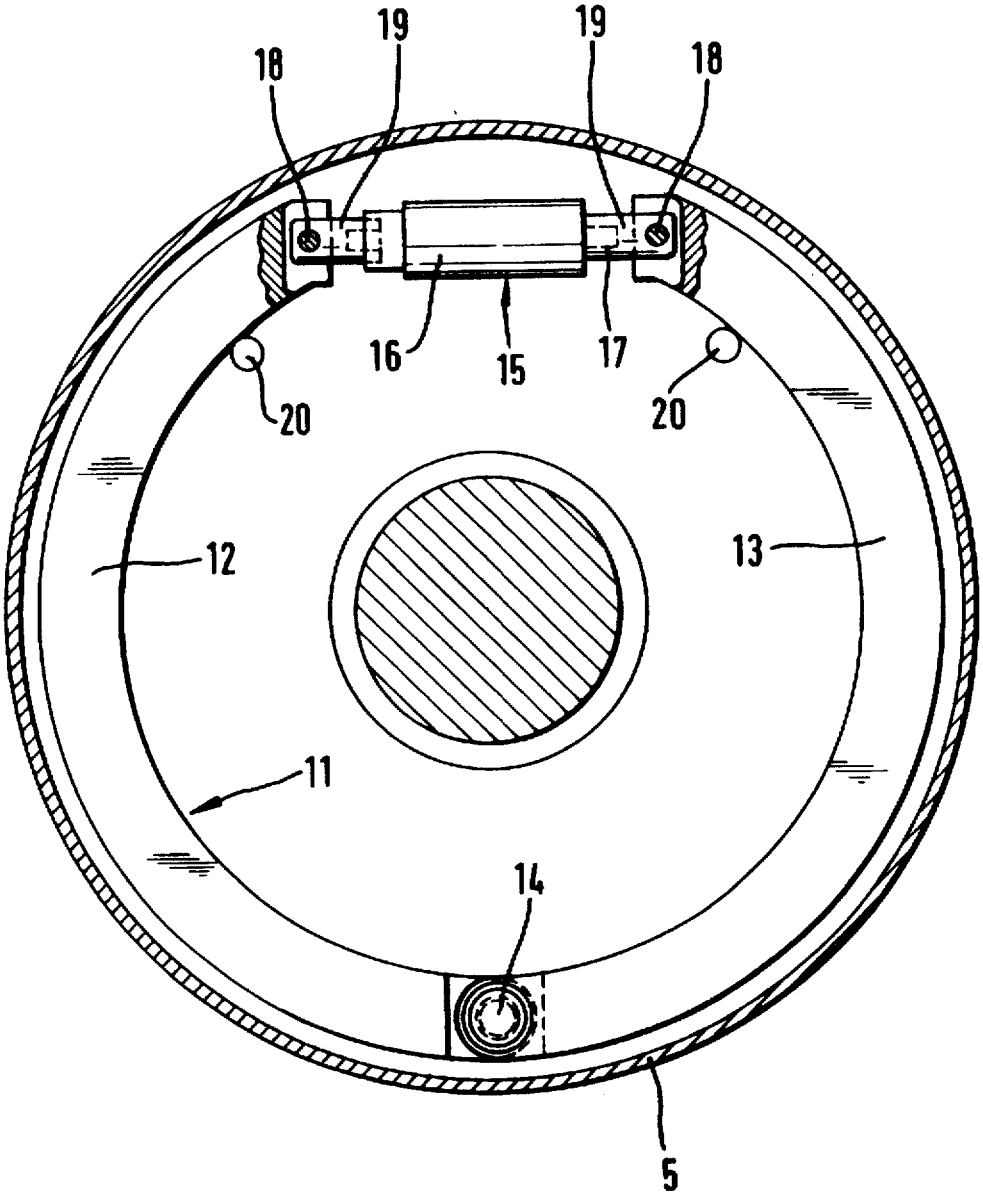
Figure 3:
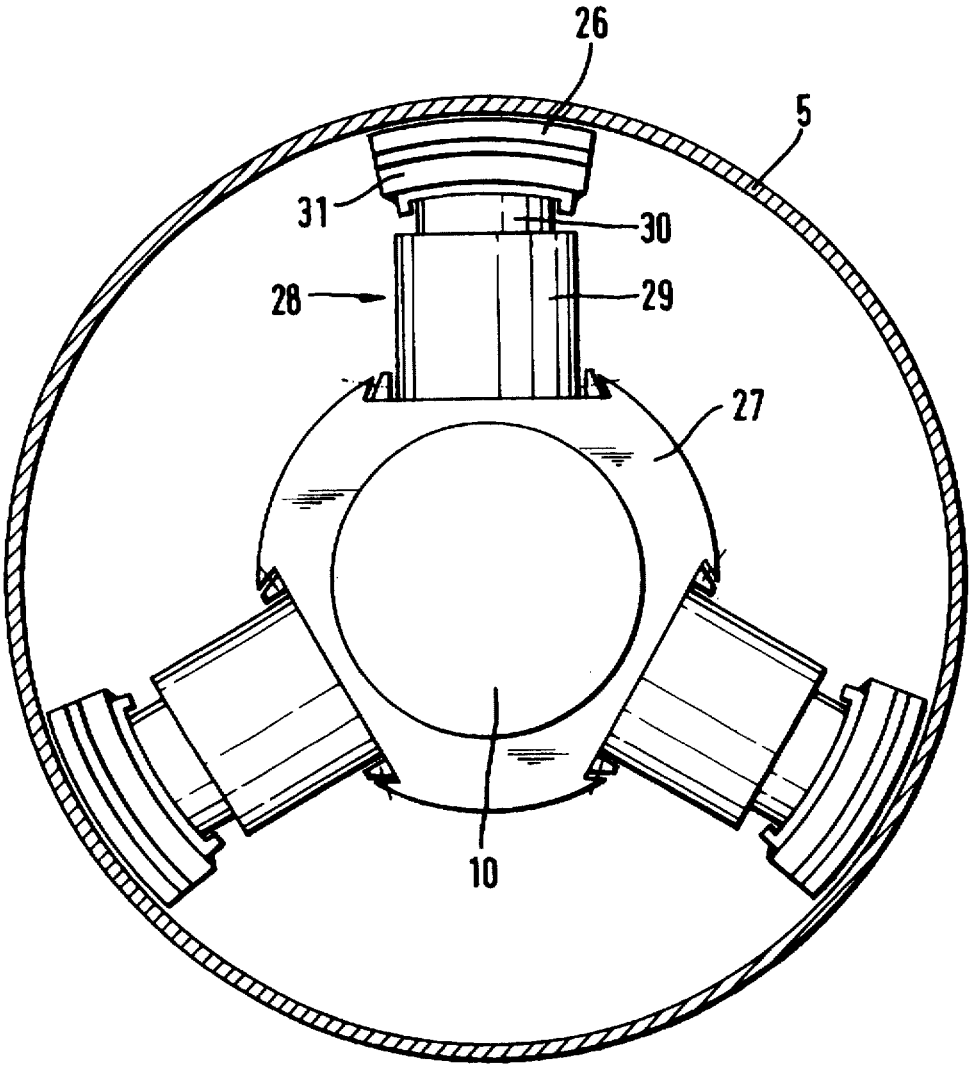
Figure 4:
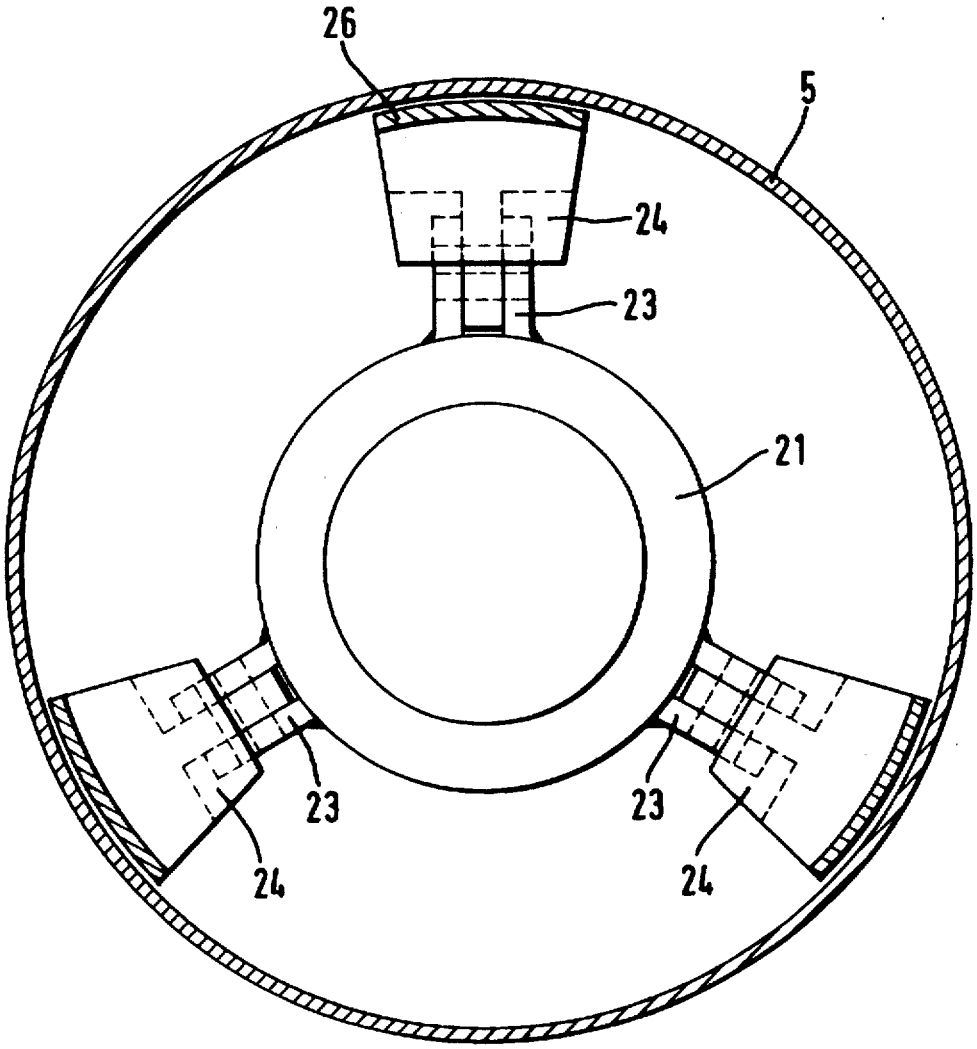
Figure 5:
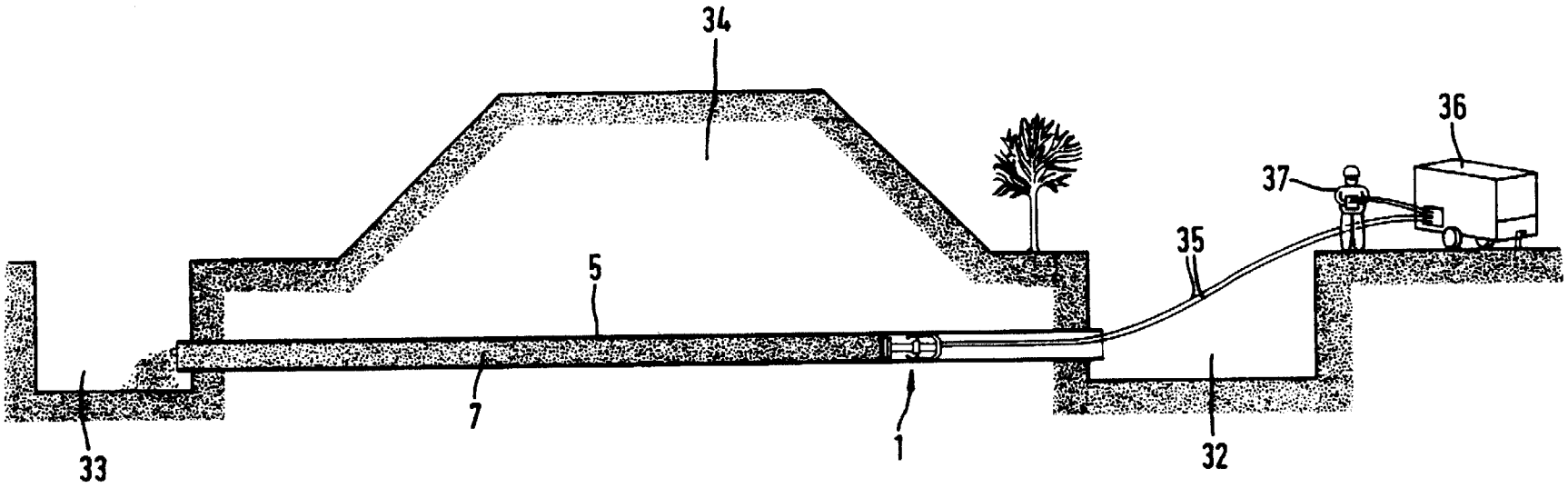

FIG. 1 schematically shows a go-devil of the invention in operation inside a pipe system. FIG. 2 is a cross-section along line 2–2 of FIG. 1, FIG. 3 is a cross-section along line 3–3 of FIG. 1, FIG. 4 is a cross-section along line 4–4 of FIG. 1, and FIG. 5 is a schematic of an application of the method of the invention using a go-devil of FIG. 1.

The go-devil 1 shown in FIGS. 1 through 4 is composed of a disk-shaped head plate 2 with a scraper ring 3 resting in radially prestressed manner against the inside wall 4 of a pipe 5. The front side 6 of the head plate 2 is used to expel an earth core 7 in front of the head plate 2 in the pipe 5. The plunger rod 9 of a double-acting hydraulic actuator cylinder 10 is affixed to the rear side 8 of the head plate 2. The plunger rod 9 is fully retracted into the actuator cylinder 10 in the position shown in FIG. 1.

A bracing system 11 is mounted to the rear side 8 of the head plate 2. The bracing system 11 comprises two bracing jaws 12, 13 which are rotatably supported by one end on a pin 14 screwed into the head plate 2. A double-acting hydraulic cylinder 15 is mounted between the opposite ends of the bracing jaws 12, 13 and the housing 16 of said cylinder is linked articulating manner with the bracing jaws 12 and the piston rod 17 of said cylinder being linked in articulating manner with the clamping jaws 13. The articulating linkage is implemented by hinge pins 18 passing through the forked end of the bracing jaws 12, 13 and through compressive parts 19 connected with the cylinder housing 16 or with the piston rod 17, with the pins 18 running parallel to the pin 14.

In the position shown in FIG. 2, the bracing jaws 12, 13 are held in place by the piston of the cylinder 15 being loaded from the compression-bar side. Stop-pins 20 in the head plate 2 assure centering of the bracing jaws 12, 13 relative to the center axis of said plate. By loading the cylinder side of the piston of cylinder 15, the movable ends of the bracing jaws 12, 13 are spread apart and these bracing jaws 12, 13 are forced by their outsides against the inside wall 4 of the pipe 5. Because of the friction between the bracing jaws 12, 13 on one hand and the inside wall 4 on the other hand, it is possible to keep in place the head plate 2 in the pipe 5 with such force that it shall not be shifted when the actuator cylinder 10 is reset.

The end of the actuator cylinder 10 opposite the head plate is rigidly affixed to a compression plate 21 of a second bracing system 22. At its periphery the compression plate 21 comprises three bearing blocks 23 in each of which a bracing shoe 24 is pivotably supported about a tangential axis on a bearing pin 25. The bracing shoes 24 are fitted with bracing skids 26 running parallel to the inside wall 4 of the pipe 5 and they evince a cylindrical outside surface of which the curvature substantially matches the curvature of the inside wall 4. Radially pointing bracing cylinders 28 are mounted between the bracing skids 25 and a bracing ring 27 enclosing the actuator cylinder 10 while leaving a little play. The bracing cylinders 28 together with their cylinder housing 29 are affixed to the bracing ring 27. The pistons of the bracing cylinders 28 rest on a compression plate 31 on the inside of the bracing skids 26.

As long as the bracing cylinders 28 are unpressurized, the bracing skids 26 function as slide guides for that part of the go-devil 1 formed by the actuator cylinder 10 and the bracing system 22. When the bracing cylinders 28 are pressurized, they will force the bracing skids 26 radially outward against the inside wall 4 of the pipe 5 so strongly that the friction so caused suffices to transmit the reaction generated during displacement of the earth core at the actuator cylinder 10 to the pipe 5.

The method for removing an earth core 7 from a pipe which is being horizontally advanced by ramming using the above described go-devil is described in further detail below and shown in FIG. 5. The Example of FIG. 5 shows a pipe 5 that was driven from a starting pit 32 through an embankment 34 into a target pit 33, with the pipe holding an earth core 7 which entered it as it advanced. A go-devil 1 of the above described design is present at the end of the pipe 5 near the start pit 32. To introduce the go-devil 1, the earth core was removed by hand for an appropriate length corresponding to that of the go-devil 1 at the pipe end facing the start pit 32. Using a suitable hoist, the go-devil 1 then was inserted into the pipe 5. The go-devil 1 is connected by pressure-hoses 35 to a drive unit 36 comprising a motor, a pump and a hydraulic control system. The control system is serviced by an is operator 37.

To remove the earth core 7, first the bracing cylinders 28 of the go-devil 1 are pressurized toward extension and thereby the bracing skids 26 are braced against the inside wall of the pipe 5. Thereupon the pressurized medium is fed to that side of the plunger of the actuator cylinder 10 which is away from the plunger rod 9 which thereby is extended and thus the head plate 2 is displaced toward the earth core 7. As a result the earth core 7 is compressed and lastly it is displaced toward the target pit 33. The reaction force against advance exerted on the head plate 2 is braced in this process through the bracing system 22 against the pipe 5.

Once the plunger rod 9 has been fully extended, the load is removed from the actuator cylinder 10, the bracing system 22 is disengaged, and, by loading the cylinder 15, the bracing jaws 12, 13 of the bracing system 11 at the head plate 2 are forced against the wall of the pipe 5. Then the plunger of the actuator cylinder 10 is pressurized on the side of the plunger rod 9 which thereby is now retracted into the actuator cylinder 10. Because the head plate 2 is locked in place during this process by the bracing system 11, the housing of the actuator cylinder 10 together with the bracing system 12 is displaced toward the head plate 2, the bracing skids 26 sliding along the inside wall of the pipe 5. Once the plunger rod 9 is fully retracted, the previously described control procedure is repeated. In this manner the go-devil 1 is displaced step by step in the pipe 5 relative to the earth core 7 which thereby is being forced out of the pipe 5 and is collected in the pit 33. The described process is unaffected by the presence of large stones, coarse clays, binding or sandy soils in the earth core because this core is being pushed from the rear over the entire length of the pipe, the rate of advance depending on the pumping output of the drive units and being monitored through the control system.

If the pipe 5 were damaged by dents and as a result would block the go-devil from passing through its full length, then the go-devil may operated in the reverse direction, that is, the plunger rod 9 would be extended while the bracing system 11 is operative and the is plunger rod 9 is retracted when the bracing system 22 is operative, and it would exit rearward from the path covered.

Preferably the hydraulic control of the actuator cylinder 10 and of the bracing systems 11, 22 is implemented through a control unit with integrated magnetic valves and main conduits for feed from and return to the control unit, or externally through a manually actuated control unit. The control unit may be mounted to the go-devil 1, the control of the magnetic valves taking place through an electric control line from the drive unit or from a battery. When using a manually actuated hydraulic control station, separate hydraulic feed lines may be run from the control station to the individual functional units, cylinder and bracing systems.

I claim:

1. A method for removing an earth core from a pipe laid in trench-less manner by ramming or pressing, the two ends of said pipe being free, said method comprising introducing a go-devil at one pipe ends and moving said go-devil longitudinally through the pipe forcing the earth core out of the other pipe end, by advancing said go-devil step by step, said go-devil having a length-variable actuator having an initial length and an extension stroke, wherein said advancing includes bracing one end of said actuator at a bracing-position braced against an inside wall of the pipe, extending the actuator through said extension stroke, bracing the other end of said actuator against the inside wall of the pipe, unbracing said one end, returning said actuator into said initial length, and unbracing said other end thereby resetting said bracing-position in the direction of advance by the amount of the step taken.

2. A go-devil comprising: a head plate, a first bracing device mounted on said head plate, a length-variable actuator, a second bracing device, the head plate being linked to one end of the actuator and the other end of the actuator being linked to said second bracing device, and a remote-controlled drive means for operating said first and second bracing devices and said actuator such that the bracing devices are alternatively moved into a bracing position wherein said devices are forced against an inside wall of a pipe or in a disengaged position wherein said devices are away from the inside wall of the pipe.

3. Go-devil defined in claim 2, wherein the actuator is a double-acting, hydraulically loaded actuator cylinder having a plunger rod and a cylinder housing, one of the plunger rod or the cylinder housing being affixed to the head plate and the other of the plunger rod or the cylinder housing being affixed to the second bracing device.

4. Go-devil defined in either of claims 2 or 3, wherein the first bracing device comprises radially displaceable bracing jaws on the head plate and a first hydraulically driven cylinder for displacing said jaws radially outward against the inside wall of the pipe, and said second bracing device comprises bracing skids mounted on said other end of the actuator and at least one second hydraulically driven cylinder for forcing said skids radially outward against the inside wall of the pipe.

5. Go-devil defined in one of claims 2 or 3, wherein the first bracing device comprises two radially displaceable bracing jaws in the manner of an inside shoe brake, said jaws being rotatably supported by one end on a pin affixed to the head plate and their opposite ends being movable apart by a spreading device.

6. (Amended) Go-devil defined in claim 5, wherein the spreading device is a double-acting hydraulic cylinder mounted between the ends of the bracing jaws and linked by kinematic linkages to the ends of the bracing jaws.

7. Go-devil defined in one of claims 2 or 3, wherein the second bracing device comprises at least two bracing shoes and bracing skids on said bracing shoes running in the longitudinal direction of the go-devil, at least one bracing shoe being radially displaceable relative to the pipe axis by a bracing cylinder resting on the other bracing shoe.

8. Go-devil defined in one of claims 2 or 3, wherein the second bracing device forms a guide through which the actuator is guided along the inside wall of the pipe.

9. Go-devil defined in claim 7, wherein the bracing shoes are pivotably supported on a compression plate affixed to an end face of the actuator.

10. Go-devil defined in claim 7, wherein said second bracing device further comprises a ring enclosing the actuator and radially supporting the bracing cylinders.

* * * * *